US008215838B1

(12) United States Patent
Colonna

(10) Patent No.: US 8,215,838 B1
(45) Date of Patent: Jul. 10, 2012

(54) COMBINATION SHOPPING BAG BOOK COVER TEMPLATE APPARATUS

(76) Inventor: Frank Colonna, Long Beach, CA (US)

( * ) Notice: Subject to any disclaimer, the term of this patent is extended or adjusted under 35 U.S.C. 154(b) by 276 days.

(21) Appl. No.: 12/614,588

(22) Filed: Nov. 9, 2009

(51) Int. Cl.
*B65D 30/00* (2006.01)

(52) U.S. Cl. ..... 383/4; 363/127

(58) Field of Classification Search ..... 383/4, 2, 383/127; 281/29, 34, 35; 229/87.18, 87.19
See application file for complete search history.

(56) References Cited

U.S. PATENT DOCUMENTS

| | | | | |
|---|---|---|---|---|
| 1,603,362 | A | 10/1926 | Stewart | |
| 1,611,403 | A * | 12/1926 | Bales | 383/4 |
| 2,518,711 | A | 8/1950 | Mulford | |
| 2,853,710 | A * | 9/1958 | Swann | 2/80 |
| 2,867,372 | A | 1/1959 | Fox | |
| 3,160,343 | A * | 12/1964 | Schantzer | 383/4 |
| 3,489,333 | A * | 1/1970 | Gale et al. | 229/87.19 |
| 5,472,237 | A | 12/1995 | Rajeswaran | |
| 5,518,313 | A * | 5/1996 | McAdam | 383/4 |
| 2003/0091245 | A1* | 5/2003 | Mencacci | 383/6 |
| 2005/0173502 | A1* | 8/2005 | Kim et al. | 229/101 |
| 2008/0217903 | A1 | 9/2008 | Bonczar | |

FOREIGN PATENT DOCUMENTS

JP 2002362648 A * 12/2002

OTHER PUBLICATIONS www.bigy.com, NAPSI School Book Covers, Big Y Foods, Inc., 2009, 1 pg., Springfield, MA.

ehow.com/how_5320713_make-bag-book-cover-schoolbooks.html, How to Make a Grocery Bag Book Cover for Schoolbooks, 1999-2009, eHow, Inc., 5 pgs., Bellevue, WA.

Andrea J. Buchanan and Miriam Peskowitz, http://www.daringbookforgirls.com/about-the-book/about-the-double-daring-book-for-girls/paper-bag-book-cover, Make a Paper Bag Book Cover, 2007-2009, 2pgs., HarperCollins Publishers, New York, NY.

* cited by examiner

*Primary Examiner* — Jes F Pascua
(74) *Attorney, Agent, or Firm* — Fulwider Patton LLP

(57) ABSTRACT

A shopping bag having walls formed on their inner surfaces with indicia defining templates corresponding with the size of selected books.

1 Claim, 3 Drawing Sheets

COMBINATION SHOPPING BAG BOOK COVER TEMPLATE APPARATUS

BACKGROUND

1. Field of the Invention

Protective covers for books.

2. Description of the Prior Art

Modern day shopping at retail outlets has led to great demand for shopping bags typically constructed of paper or plastic and designed for containing a number of parcels, such as groceries which consumers making the shopping trip might employ for carrying the groceries from the store to the car and then at the residence from the car to the kitchen or other storage area.

In this regard, consumers will often times make several trips to the grocery store each month, often times purchasing such a quantity of groceries that five, seven, ten or even fifteen or more shopping bags might be required to conveniently transport the groceries from the store. After use, these bags are often then discarded to the garbage and then into landfills or possibly even to recycling centers. This consumption of paper bags thus contributes to the harvesting of additional quantities timber each year thus accelerating the rate of deforestation. The exponential increase in the consumption of plastic shopping bags in just the last few years and their slow rate of decomposition has resulted in the recognition that the bags themselves has not only added to the demand for petrochemicals but left society with a huge quantity of discarded and unwanted plastic bags which constitute such a nuisance and blight to the environment spurred many legislative bodies have been spurred to enact legislation limiting the use of plastic bags as such.

Meanwhile, it is well-known that students from the elementary classes through graduate school, each year require multiple books for their classes and study subjects and that the covers of such books can best be preserved for the school year and in some instances for subsequent resale, by placing protective covers on the books. In many instances, the books themselves are even sold with durable covers to protect the integrated book covers themselves but even then, the protective covers may become torn, ripped, worn, lost or discarded thus leaving the books themselves exposed to damage and deterioration from every day use and possible exposure to the elements.

It has long been a practice of parents and teachers for younger students, for instance, elementary students, to endeavor to persuade students to utilize wrapping paper and shopping bags to make individual book covers for their individual books. With current day society demands on parent, teacher and student time, this practice has, to a great extent, lost popularity and detracts from the time and opportunity available for teaching students to follow the expedient of cutting down shopping bags and cutting out individual book covers on a trial and error basis. As a result, society continues to contribute on a regular basis to filling up landfills and burdening the recycling industry with disposals of millions of shopping bags which could well be serving a second life as protective book covers.

In recognition of the fact that benefits could be had from recycling grocery bags as protective book covers, various procedures have been published and promoted proposing different methods for breakdown of individual grocery bags and seeking to outline the shape of the subject book and, to the extent successful, folding over at the edges to make individual book covers. Examples of these procedures have been published on-line so that access could be had to these procedures by those having the individual motivation and discipline to familiarize themselves with those procedures and spend the time experimenting with different shopping bags and making individual protective covers. Such procedures have not gained any popularity and do little to promote a second life for shopping bags serving as protective book covers.

Applicant is unaware of any shopping bag devices which themselves incorporate a ready graphic predetermined illustration of templates corresponding with the various common sizes of books to encourage the convenient breaking down of shopping bags for quick and convenient and foolproof sizing to closely fit different sizes of books.

SUMMARY OF THE INVENTION

The combination shopping bag and book cover apparatus of the present invention is characterized by indicia on the interior of the shopping bag material defining templates of predetermined sizes and shapes corresponding with selected sizes of books for ready breakdown of the shopping bag and cutting to size to form protective book covers which may be conveniently positioned on the books themselves.

Advantageously, in one aspect of the present invention, the method of making the cover includes cutting of the shopping bag material along the outline of a selected one of the templates to form an oversized book cover to be folded over the edges of the front and back covers of the book to be adhered in two places for providing a durable protective cover for the selected book.

DETAILED DESCRIPTION OF THE PREFERRED EMBODIMENTS

The combination shopping bag and protective book cover apparatus of the present invention includes, generally, a shopping bag of 21 configured on its interior surface with indicia defining rectangular template patterns 23, 25 and 27.

Shoppers for dry goods, clothing and groceries typically enjoy the convenience of large containers, such as shopping bags for toting their purchases from the retail store to the bus, car or train so as to enjoy the convenience of containing the purchased items in bags which are convenient to carry and in some instances include handles or bails. The proliferation of the demand for shopping bags has led to a problem with disposal, a problem reflected in various different municipal and other governmental codes limiting the use of plastic shopping bags and encouraging the use of reusable canvas bags or the like which the shopper might bring to the store and have available for loading of the purchased items for convenient toting to his or her mode of transportation. These restrictions on use of disposable shopping bags has created a dilemma with retail stores in that customers still tend to demand plastic or paper shopping bags and often times are unwilling or forgetful in utilizing reusable canvas bags and, even then, often times have insufficient capacity to carry the purchased items. This problem could be alleviated by a shopping bag that has a multiple usages so that it, in effect, has a second life as a protective book cover. It is this problem to which the present invention is directed.

Standard books are available books are available in various sizes but typically have a height of approximately 10" or 12" inches and down to 7" inches or smaller for small handbooks and the like and might have a width on each side of 9", 10" or 12" inches and a thickness of ½", 1", or 1½" inches to thus produce a dimension of, for instances 8", 11" or 12" inches span across the width of the front and back covers and including the thickness of the spine. My invention addresses the issue of utilizing readily available flexible shopping bags to cover books of these and other standard sizes.

In my exemplary embodiment I utilize a bag 21 constructed of paper and conveniently including handles 31 and displaying on the exterior of the front and/or back sides thereof graphics 33 which, in practice, will be advertising for the retailer or in some instances, advertising sold to third parties.

Figure 3:
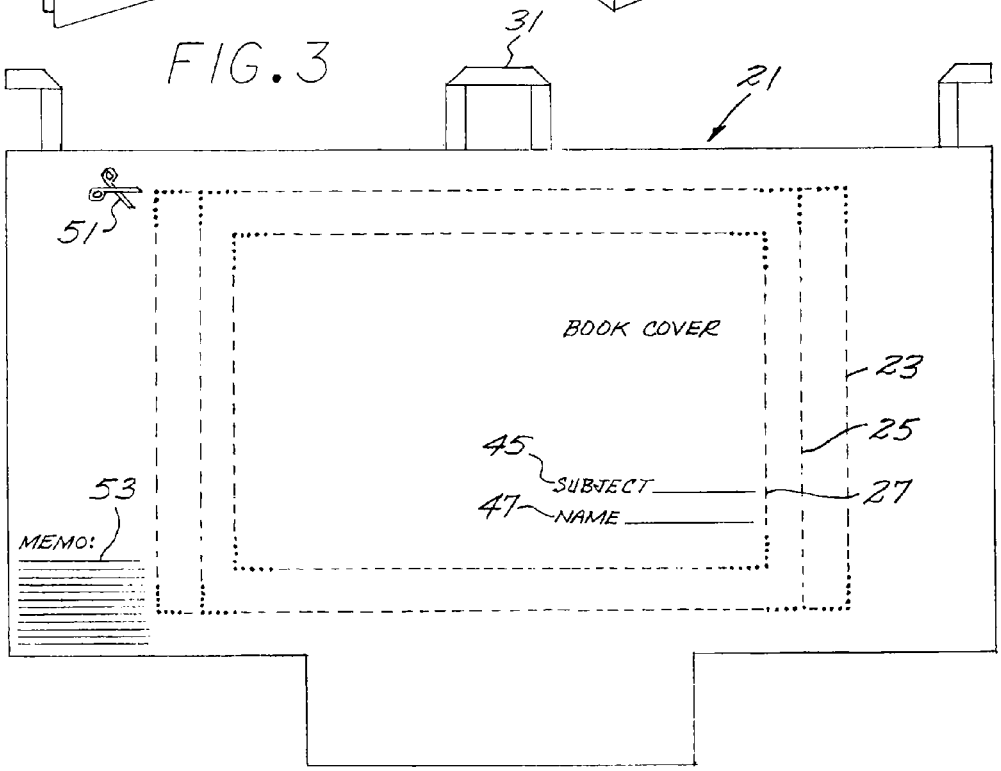
FIG. 3 is a top plan view of the shopping bag cut open and broken down into a flat pattern.

My preferred embodiment includes severing indicia on the interior of the bag which incorporates a vertical line 35 on the back wall and extending through the handle 31 at 37 to form a guideline for cutting of the bag open to be flattened out into the configuration shown in FIG. 3.

The interior surface of the bag is formed along the front wall and end walls with broken lines defining the respective top, bottom and opposite ends of the respective templates 23, 25 and 27 which, in practice, are selected to be oversized by about 1 inch along each margin of a book, generally designated 41, to be covered by the protective cover.

I have selected the smaller template 27 with a height of 8 inches and a width of 11 inches to correspond with a book having a height of 6 inches width of back and front covers of 9 inches and spine 1½ inch thickness.

I have selected the templates 23 and 25 with a height of 9½ inches and a length span of 13 inches to cover a book having a height of 7½ inches and front and back covers having a width of 10 inches and spine 1½ inch thick.

Also printed on the interior of the bag and within the confines of the outline of the respective templates are indicia and lines for the subject 45 of the book to be covered and name 47 of the owner of the book. As an additional convenience, I include an icon 51 of a pair of scissors clarifying that the selected template is to be cut along the lines defined.

I also include a space 53 for indicia to provide instruction for promotion to the customer as the case may be.

For the purpose of illustration, I have selected a book 41 having a height of 7½" inches, width of 10" inches and thickness of 1" inch along the spine 57.

Figure 1:
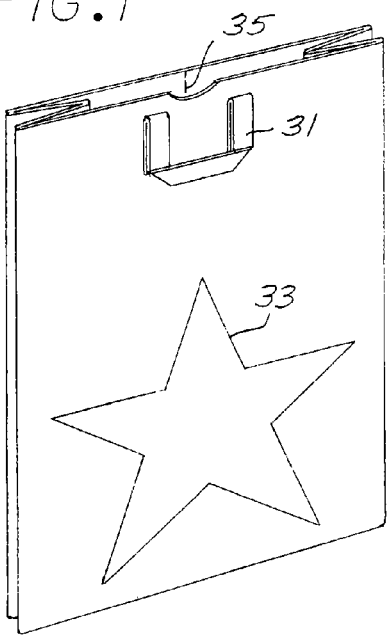
FIG. 1 is a perspective view of a folded shopping bag incorporating the present invention.
Figure 2:
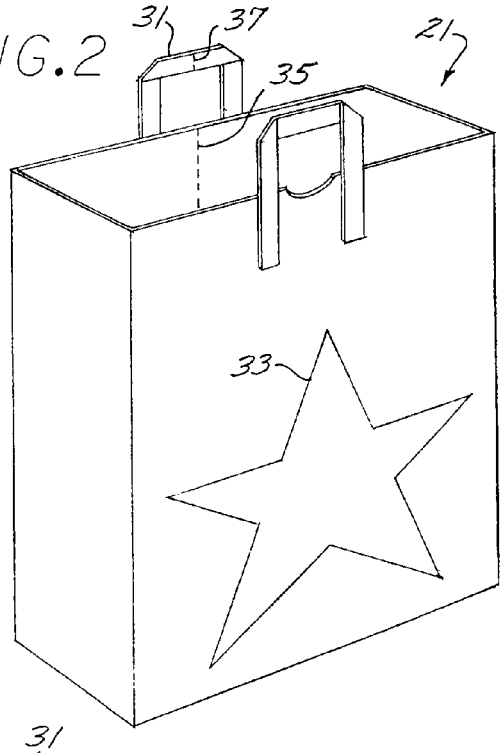
FIG. 2 is a respective view similar to FIG. 1 but showing the shopping bag expanded.

As an example of the method of the present invention, I illustrate the flat pattern shown in FIG. 3 made from cutting along the lines 35 and 37 of the bag shown in FIG. 2 to lay the interior surface out flat face up on a flat surface.

The user will then select the size of template corresponding with the particular book selected. Here, the user will select the template 23 and will cut along the vertical and horizontal lines defining the top and bottom of the template as well as the opposite edges to create a book cover sheet 40.

Figure 4:
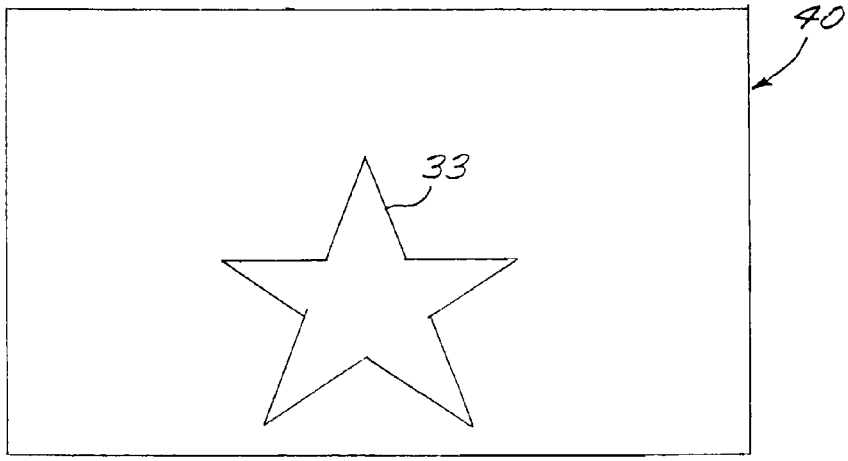
FIG. 4 is a bottom view of an oversized protective cover cut from a template incorporated in the bag shown in FIG. 3.

As suggested by the icon 51, the user will cut along the outline of the template 23 to free the template from the body of the shopping bag itself and lay the template on a flat surface with the exterior surface face up as shown in FIG. 4.

Figure 5:
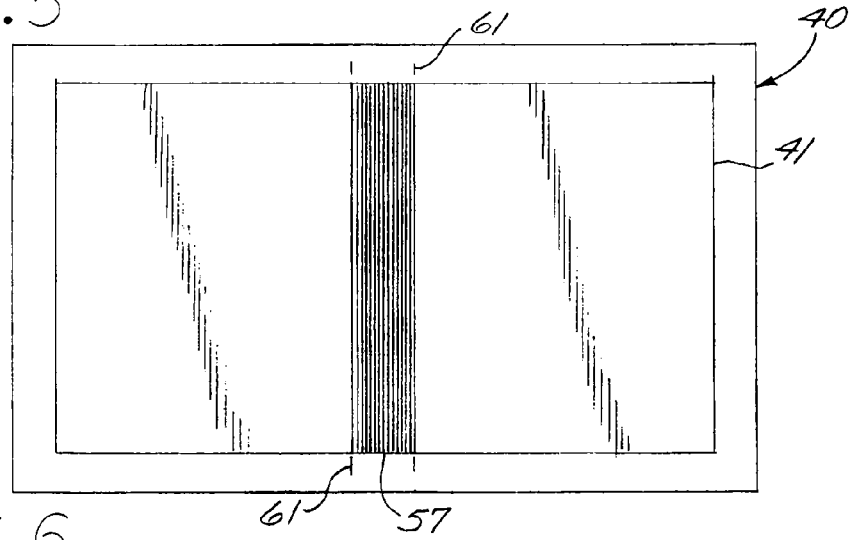
FIG. 5 is a view similar to FIG. 4 but showing a book centered over the cover.
Figure 6:
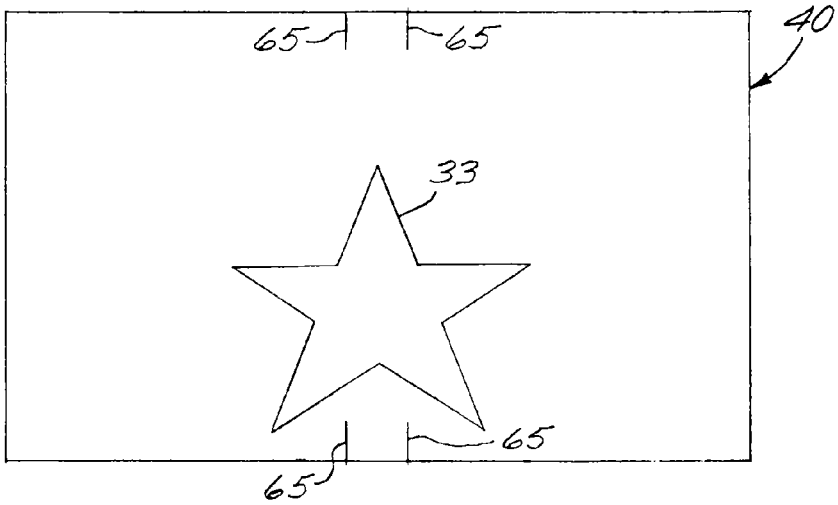
FIG. 6 is a bottom plan view similar to FIG. 4 but depicting cuts spaced laterally apart corresponding with the width of the spine incorporated in the book shown in FIG. 5 to form tabs.

The user may then place the book 41 over an open central page as shown in FIG. 5 with the spine 57 centered in the template. The user may then place pencil marks 61 at the top and bottom of the template corresponding with the opposite edges of the spine 57. The user may then cut lines 65 along the mark 61 corresponding with the opposite sides of the spine 57 to free short tabs 71.

Figure 7:
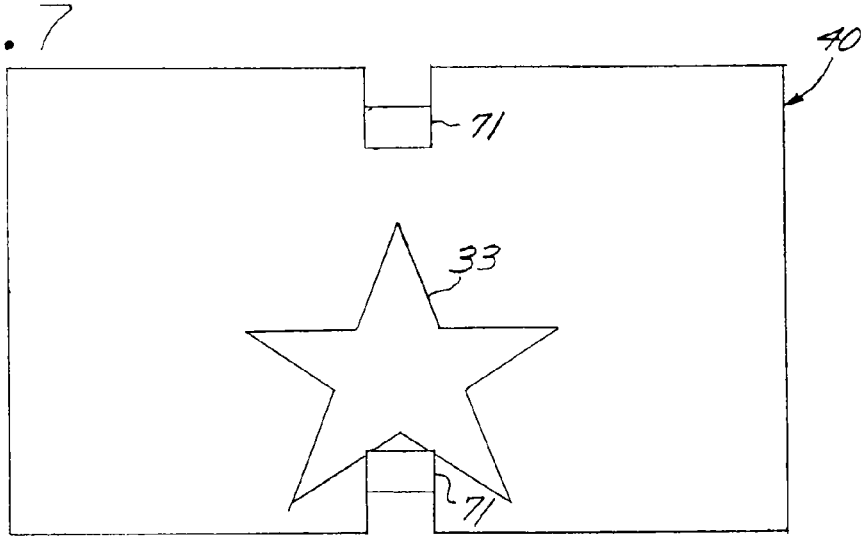
FIG. 7 is a bottom plan view similar to FIG. 6 but depicting the spine tabs folded over.
Figure 8:
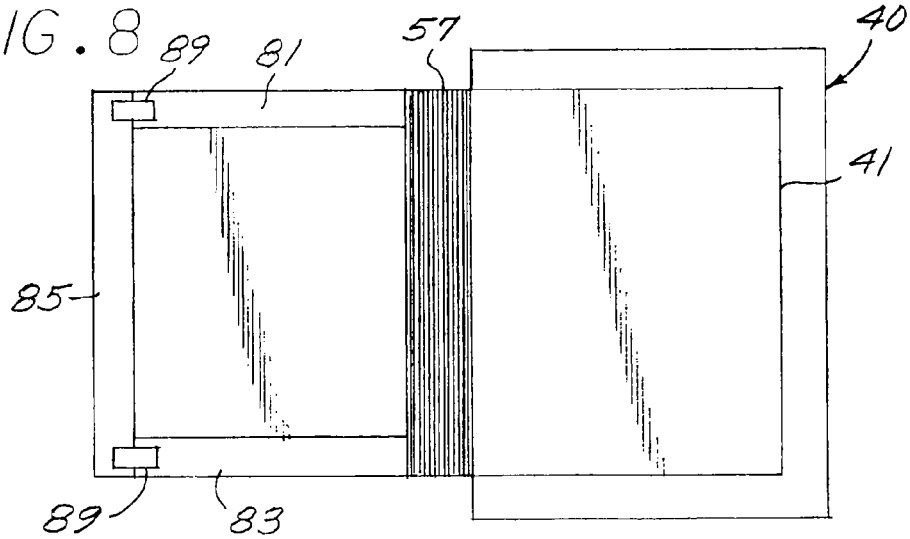
FIG. 8 is a bottom plan view similar to FIG. 7 but depicting the book centered on the cover with the marginal edges on the left hand side folded over the edges of the front cover of the book.

Referring to FIG. 7, the tabs 71 may then be folded inwardly as depicted and the book 41 placed on the template as shown in FIG. 8.

As viewed in FIG. 8, the top bottom and edge margins 81, 83 and 85 may then be folded over the respective top, bottom and free edges of the front cover of the book and adhesive tape 89 applied to hold the margins in place.

Figure 9:
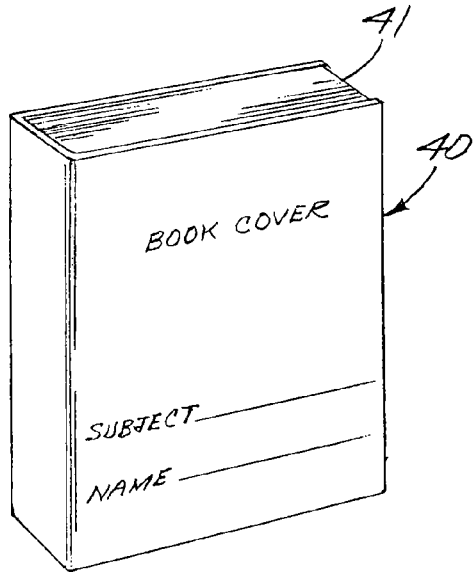
FIG. 9 is a perspective view of the protective cover shown in FIG. 8 positioned installed in covering relationship on the book.

This procedure may then be repeated with respect to the back cover of the book to thus leave the book 41 securing covered with a durable protective covering shown in FIG. 9.

From the foregoing, it will be appreciated that the apparatus and method of the present invention provides a convenient means for inducing a consumer to utilize the shopping bag of the present invention as a protective cover for a selected book to thus provide a second life for the shopping bag and thereby reduce the load on landfill capacity and or recycle services.

I claim:

1. Combination grocery shopping bag and book cover apparatus for covering a selected book from predetermined first and second groups of books, the first group having front and back covers with heights of 6 inches, widths of 9 inches and a spine width of 1½ inches, the second group having front and back covers with heights of 7½ inches and respective widths of 10 inches, and a spine width of 1 inch, the apparatus comprising:

a paper grocery shopping bag having front, back and opposite end walls with respective inside surfaces:

indicia on the inside surfaces of at least the front or back walls and the end walls defining first and second rectangular outlines forming first and second templates having respective top and bottom sides and opposite ends and sized to, when the shopping bag is open and laid flat, correspond with the respective heights and combined widths of the front and back covers and spines of the respective first and second groups of books, and including a border of substantially 1 inch at the respective top and bottom and opposite ends of the templates whereby a user may use the grocery shopping bag to tote groceries and then sever one of the walls of the bag and lay it flat with the inner surface exposed, and select a selected one of the templates corresponding with a selected book from the first and second groups, sever the selected one of the templates along respective outline to free the selected one of the templates to cover the respective front and back covers and spine of the selected book.

* * * * *